US009144893B2

(12) United States Patent
Su

(10) Patent No.: US 9,144,893 B2
(45) Date of Patent: Sep. 29, 2015

(54) REINFORCED DRIVE TOOL

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 259 days.

(21) Appl. No.: 13/959,794

(22) Filed: Aug. 6, 2013

(65) Prior Publication Data

US 2014/0196581 A1 Jul. 17, 2014

(30) Foreign Application Priority Data

Jan. 17, 2013 (TW) ..... 102101826 A

(51) Int. Cl.

| | |
|---|---|
| ***B25B 15/00*** | (2006.01) |
| ***B25B 13/06*** | (2006.01) |
| ***B25B 23/00*** | (2006.01) |
| ***B25B 13/56*** | (2006.01) |

(52) U.S. Cl.

CPC ..... *B25B 15/008* (2013.01); *B25B 13/06* (2013.01); *B25B 13/56* (2013.01); *B25B 23/0007* (2013.01)

(58) Field of Classification Search

CPC ..... B25B 15/008; B25B 13/06; B25B 13/56; B25B 23/0035

USPC ..... D8/29

See application file for complete search history.

(56) References Cited

U.S. PATENT DOCUMENTS

| | | | | | |
|---|---|---|---|---|---|
| 4,982,632 | A * | 1/1991 | Barmore | 81/438 |
| D359,669 | S * | 6/1995 | Splingaire | D8/29 |
| 5,485,769 | A * | 1/1996 | Olson et al. | 81/177.85 |
| 5,970,826 | A * | 10/1999 | Iwinski et al. | 81/124.6 |
| D425,385 | S * | 5/2000 | Jarvis | D8/29 |
| 7,077,037 | B2 * | 7/2006 | Shevela et al. | 81/436 |
| 7,597,031 | B2 * | 10/2009 | Chiang | 81/177.7 |
| 7,841,261 | B2 * | 11/2010 | Milligan et al. | 81/121.1 |
| 7,913,590 | B2 * | 3/2011 | Lin | 81/121.1 |
| D636,650 | S * | 4/2011 | Laurie | D8/29 |
| 8,366,120 | B2 * | 2/2013 | Hu | 279/82 |
| 8,690,164 | B2 * | 4/2014 | Meng | 279/75 |
| 9,027,445 | B2 * | 5/2015 | Sumg | 81/121.1 |
| 2006/0175773 | A1 * | 8/2006 | Tsai et al. | 279/143 |
| 2007/0044602 | A1 * | 3/2007 | Petit et al. | 81/438 |
| 2010/0122926 | A1 * | 5/2010 | Tocco et al. | 206/379 |
| 2011/0100167 | A1 * | 5/2011 | Tsai | 81/124.6 |
| 2012/0031242 | A1 * | 2/2012 | Li et al. | 81/121.1 |

(Continued)

FOREIGN PATENT DOCUMENTS

TW M390203 U 10/2010

*Primary Examiner* — David B Thomas

(74) *Attorney, Agent, or Firm* — Alan D. Kamrath; Kamrath IP Lawfirm, P.A.

(57) ABSTRACT

A socket includes a hole having a hexagonal cross section and defining six abutting sides and an included angle between any of the two adjacent abutting sides. Any of the two opposite abutting sides spaced at a first distance. Any of the two opposite included angles spaced at a second distance. The socket has first, second, and third sections having first, second and third external diameters, respectively. The second external diameter is smaller than the first external diameter and the third external diameter is smaller than the second external diameter, respectively. A difference between the second and third external diameters is not less than a difference between the first and second distances. A drive bit is mounted to the second end of the socket.

19 Claims, 8 Drawing Sheets

(56) References Cited

U.S. PATENT DOCUMENTS

2012/0060656 A1* 3/2012 Chang ..... 81/438
2012/0174717 A1* 7/2012 Richardson ..... 81/177.85
2014/0013905 A1* 1/2014 Li ..... 81/124.4
2014/0096654 A1* 4/2014 Cummings et al. ..... 81/124.4

* cited by examiner

REINFORCED DRIVE TOOL

BACKGROUND OF THE INVENTION

1. Field of the Invention

The present invention relates to a drive tool and, particularly to a reinforced drive tool.

2. Description of the Related Art

TW Patent No. M390203 shows a tool including at least one working head end and having a hexagonal body. A user can use the working head end to drive a screw. The body is engagable in a hexagonal hole defined in a socket. Additionally, it is appreciated that the tool is received in a smaller end of socket. Therefore, it is convenient for the user to insert the smaller end of the socket in a hole. Also, it is appreciated that the socket has a larger end, as it has a larger diametrical outer periphery than that of the smaller end, for reinforcing the structure of the socket. Additionally, the smaller end of the socket has a circular outer periphery. Therefore, the wall between the periphery of the hexagonal hole and the outer periphery of the socket has non-uniform thickness. However, the wall thickness that is thinner is susceptible to a stress concentration when the socket is subject to a torque, and the socket can have cracks in its wall.

The present invention is, therefore, intended to obviate or at least alleviate the problems encountered in the prior art.

SUMMARY OF THE INVENTION

According to the present invention, a reinforced drive tool includes a socket having a first end adapted for a user to operate and a second end opposite the first end adapted to be used to drive an object to be driven by the reinforced drive tool. A hole is extended along a longitudinal axis and defined at the second end of the socket. The hole has a hexagonal cross section and defining six abutting sides and an included angle between any of the two adjacent abutting sides. Any of the two opposite abutting sides are spaced at a first distance and any of the two opposite included angles spaced at a second distance, respectively. The socket has first, second, and third sections and each of the first, second, and third sections have a circular periphery. The first section is disposed at the first end and the second section defining a reinforcing section is disposed at the second end and the third section defining a neck disposed between the first and second sections, respectively. The first, second and third sections have first, second and third external diameters, respectively. The second external diameter is smaller than the first external diameter and the third external diameter is smaller than the second external diameter, respectively. A difference between the second and third external diameters is not less than a difference between the first and second distances. A drive bit adapted to be used to drive the object to be driven mounted to the second end of the socket.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a reinforced drive tool It is another object of the present invention to provide a reinforced drive tool connectable to and able to be driven by a power tool.

Other objects, advantages, and new features of the present invention will become apparent from the following detailed description of the invention when considered in conjunction with the accompanied drawings.

DETAILED DESCRIPTION OF THE INVENTION

Figure 1:
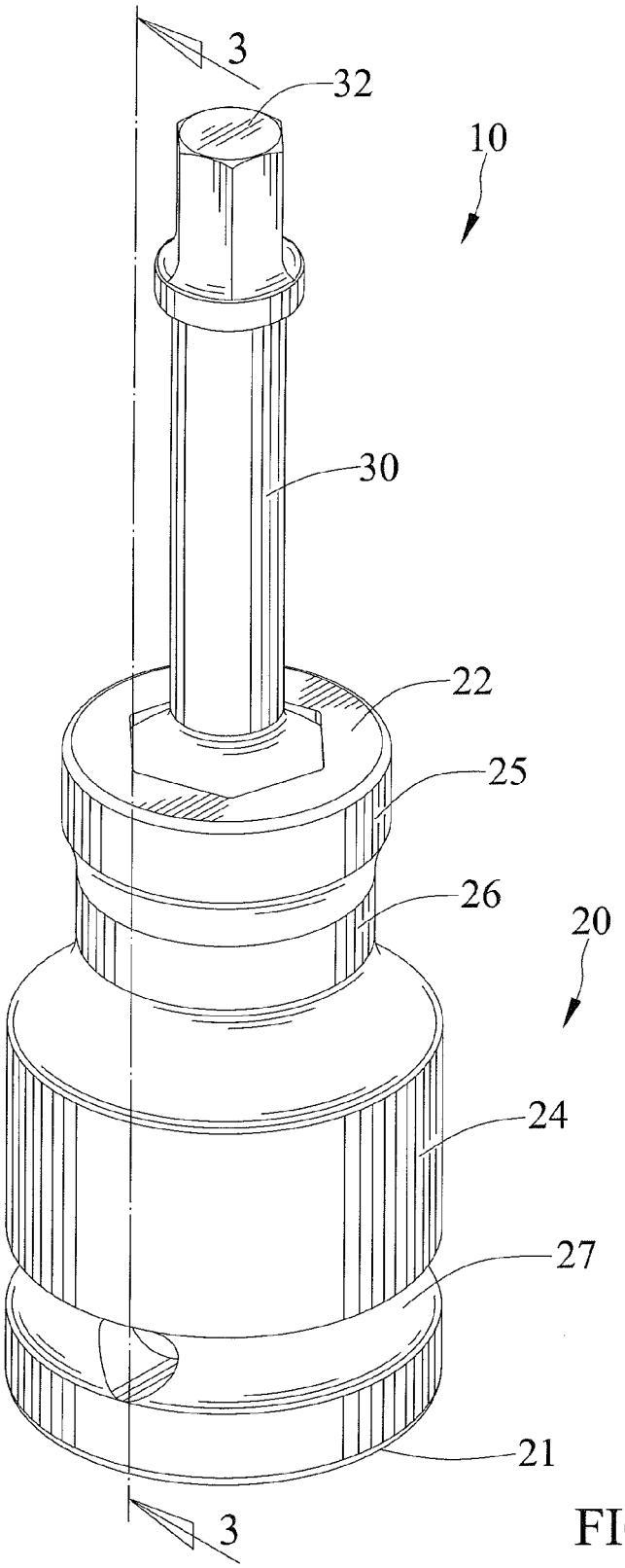
FIG. 1 is a perspective view of a reinforced drive tool in accordance with a first embodiment of the present invention.
Figure 2:
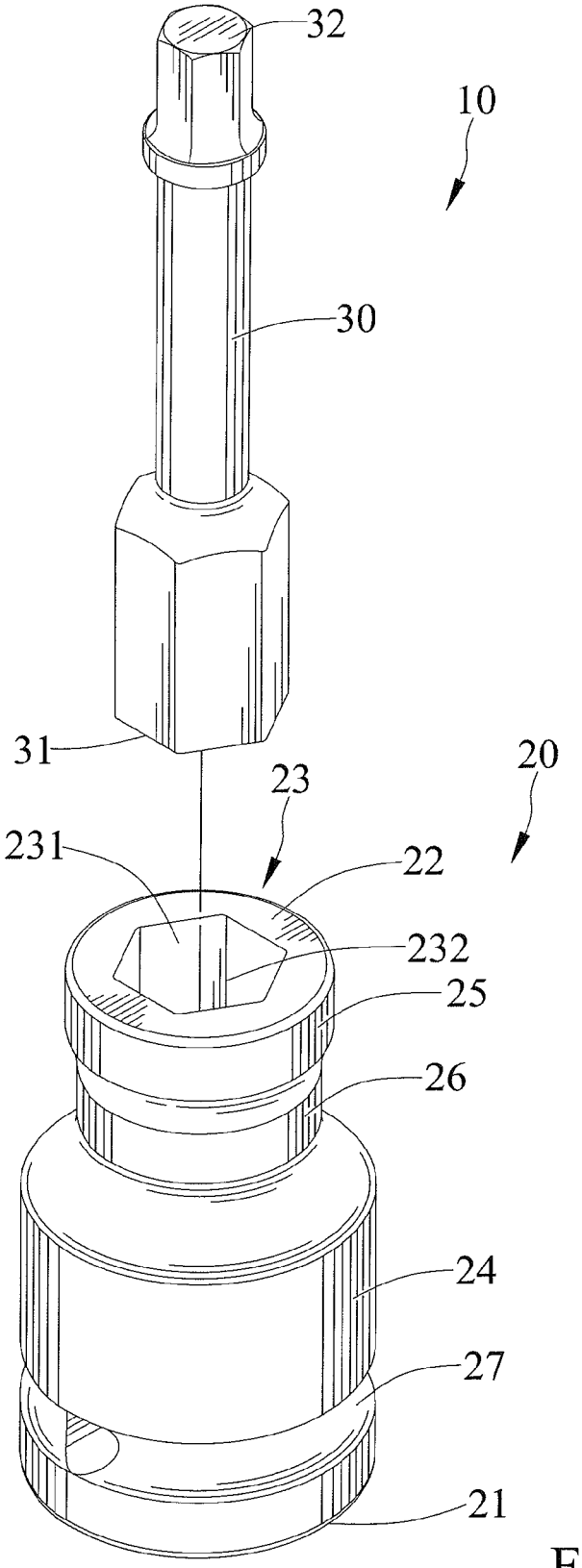
FIG. 2 is an exploded perspective view of the reinforced drive tool of FIG. 1
Figure 3:
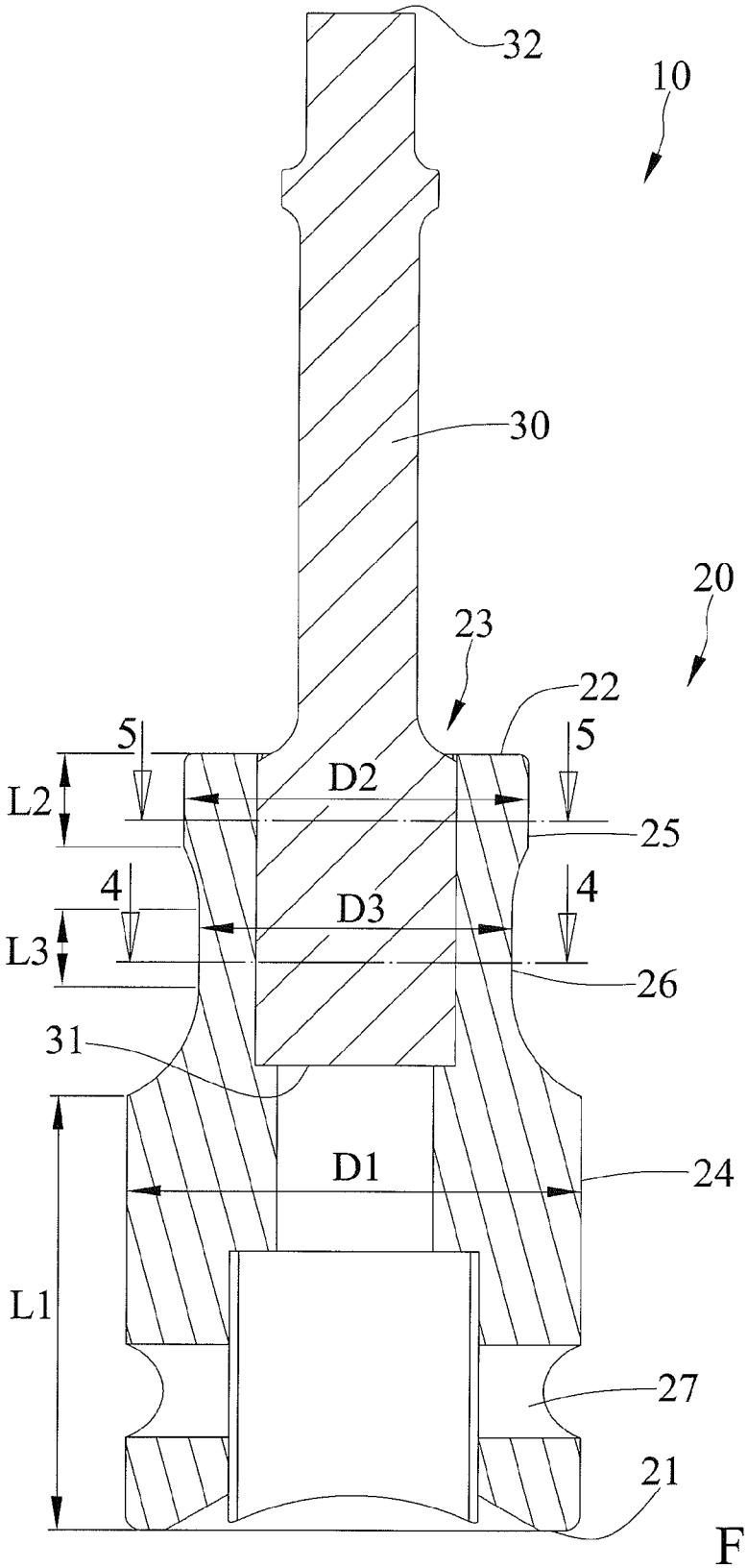
FIG. 3 is a cross-sectional view taken along line 3-3 of FIG. 1.
Figure 4:
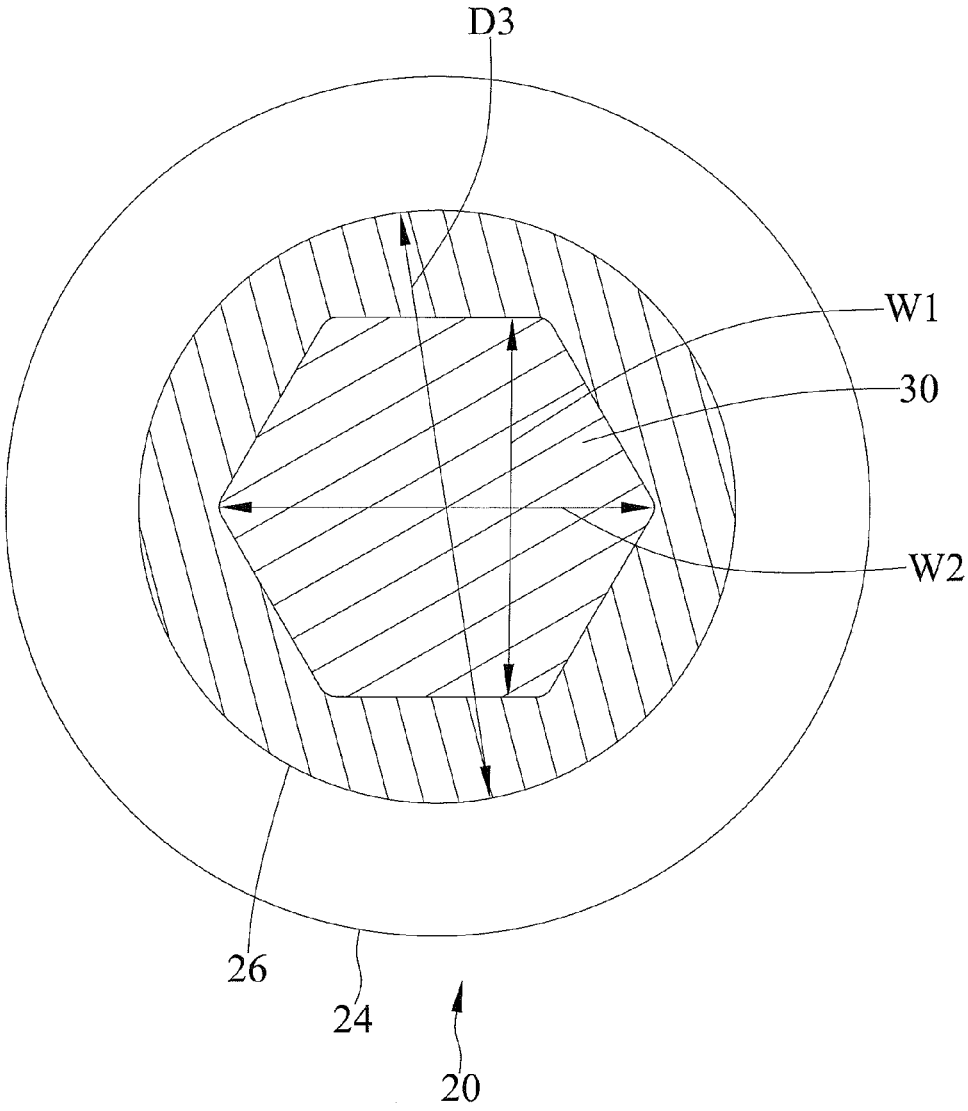
FIG. 4 is a cross-sectional view taken along line 4-4 of FIG. 3.
Figure 5:
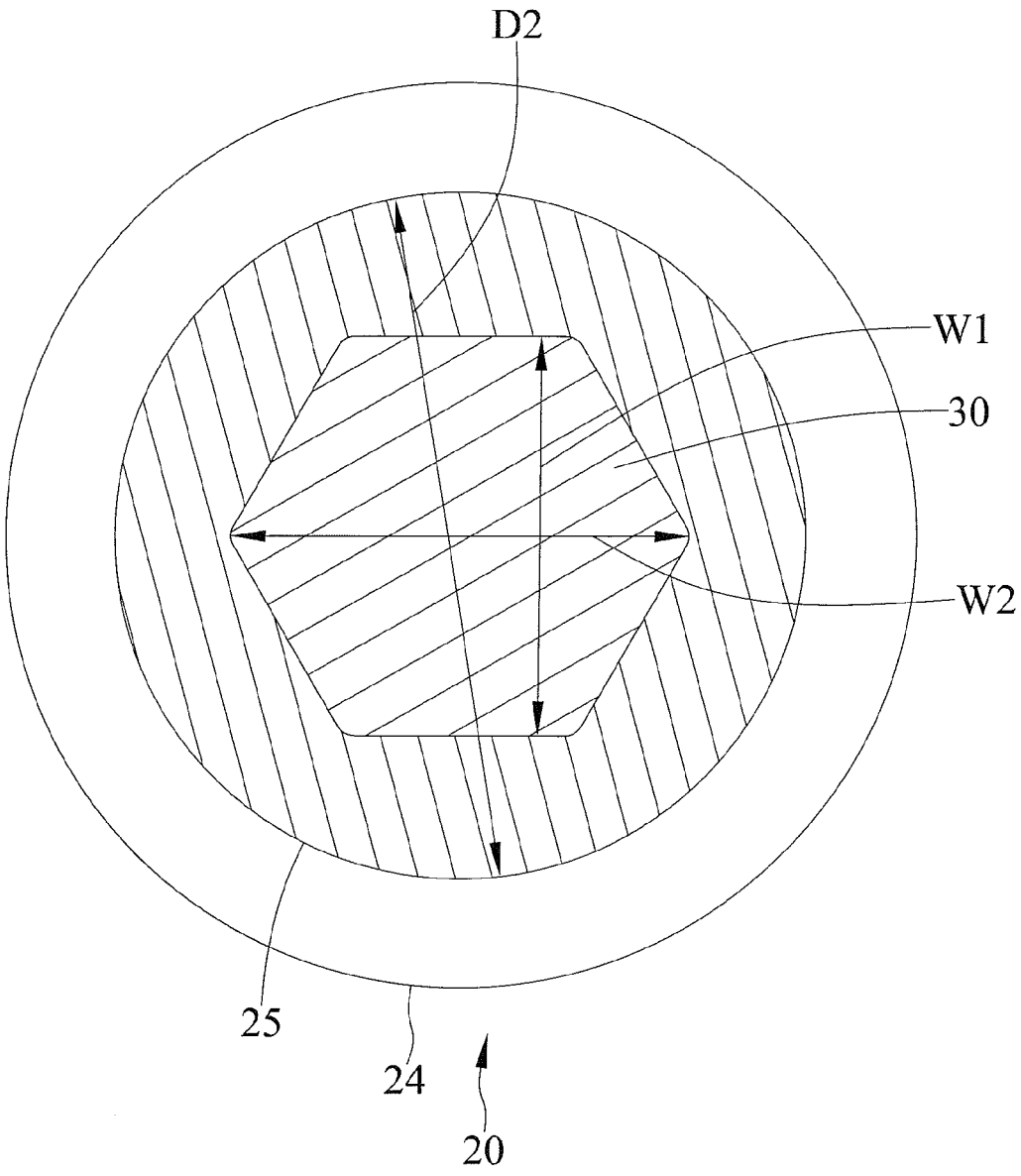
FIG. 5 is a cross-sectional view taken along line 5-5 of FIG. 3.

FIGS. 1 through 7 show a reinforced drive tool 10 in accordance with a first embodiment of the present invention. The reinforced drive tool 10 includes a socket 20 and a drive bit 30.

The socket 20 has a first end 21 connectable to a hand tool or a power and a second end 22 opposite the first end 21 and engagable with an object to be driven by the reinforced drive tool 10. The socket 20 is made in a one-piece structure. Further, a hole 23 is extended along a longitudinal axis and defined at the second end 22 of the socket 20. The hole 23 has a hexagonal cross section and defines six abutting sides 231 and an included angle 232 between any of the two adjacent abutting sides 231. Any of the two opposite abutting sides 231 are spaced at a first distance W1. Any of the two opposite included angles are spaced at a second distance W2. Moreover, the socket 20 has first, second, and third sections 24, 25, and 26 and each of the first, second, and third sections 24, 25, and 26 have a circular periphery. The first section 24 is disposed at the first end 21 and the second section 25 defining a reinforcing section is disposed at the second end 22 and the third section 26 defining a neck is disposed between the first and second sections 24 and 25, respectively. The first, second and third sections 24, 25, and 26 have first, second and third external diameters D1, D2, and D3, respectively. The second external diameter D2 is smaller than the first external diameter D1 and the third external diameter D3 is smaller than the second external diameter D2, respectively. The third external diameter D3 is greater than 0.8 times the second external diameter D2. Additionally, a difference between the second and third external diameters D2 and D3 is not less than a difference between the first and second distances W1 and W2. The difference between the second and third external diameters D2 and D3 equal the difference between the first and second distances W1 and W2 is within the scope of the invention. Moreover, the first, second, and third sections 24, 25, and 26 has first, second, and third lengths L1, L2, and L3 along the longitudinal axis of the socket 20, respectively. The total of the second and third lengths L2 and L3 is less than the first length L1. The third length L3 is less than 1.2 times the second length L2. The third length L3 is greater than 0.8 times the second length L2. The second length L2 can equal the third length L3 is within the scope of the invention. Further, an air channel 27 is circumferentially extended on an outer periphery and disposed at the first end 21 of the socket 20, and a vent (not numbered) is radially inset in the air channel 27 and in communication with a receptacle (not numbered) in which a joint of the power tool 90 is engaged. The air channel 27 has a semicircular cross section.

Figure 6:
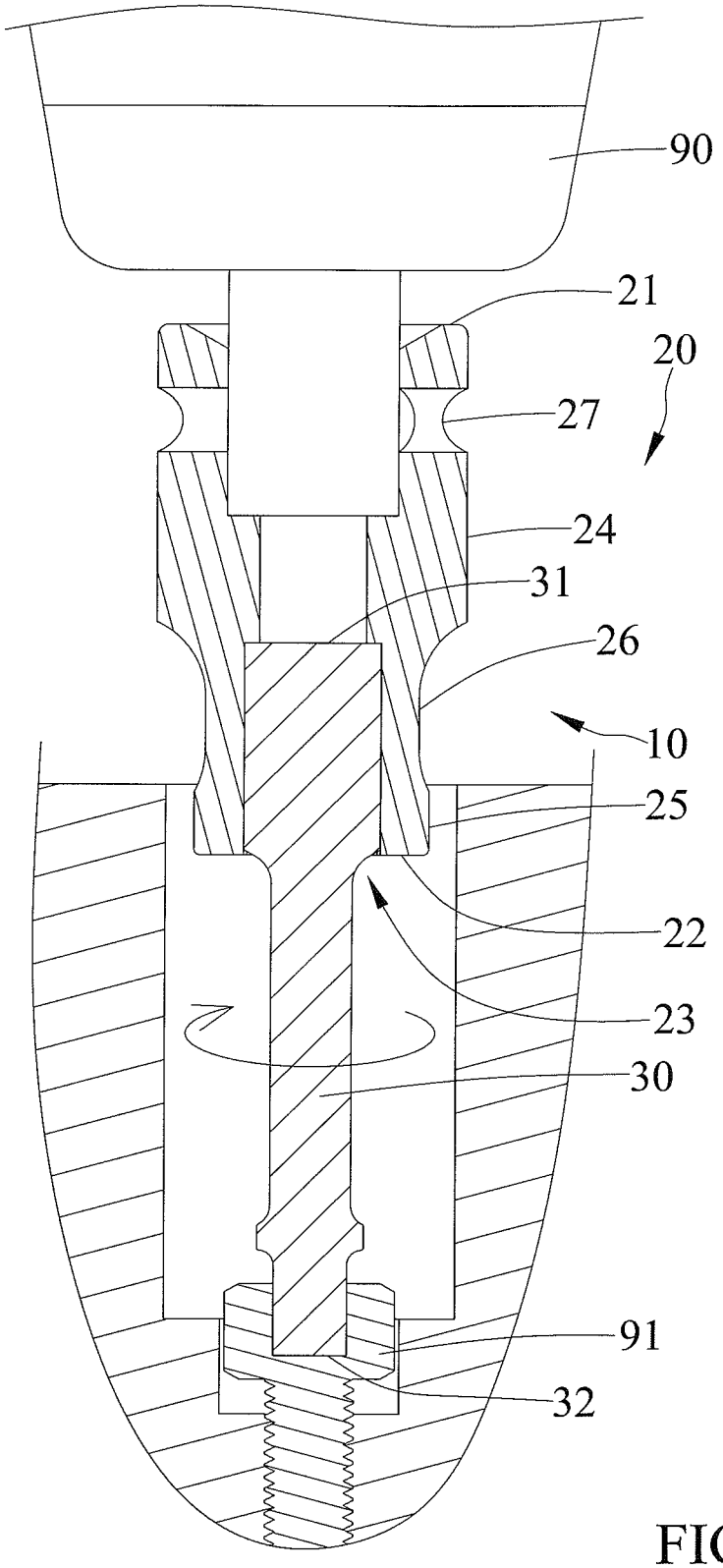
FIG. 6 is a cross-sectional view showing the reinforced drive tool of FIG. 1 in an operation of driving a fastener into a blind hole, with the reinforced drive tool driven by a power tool.
Figure 7:
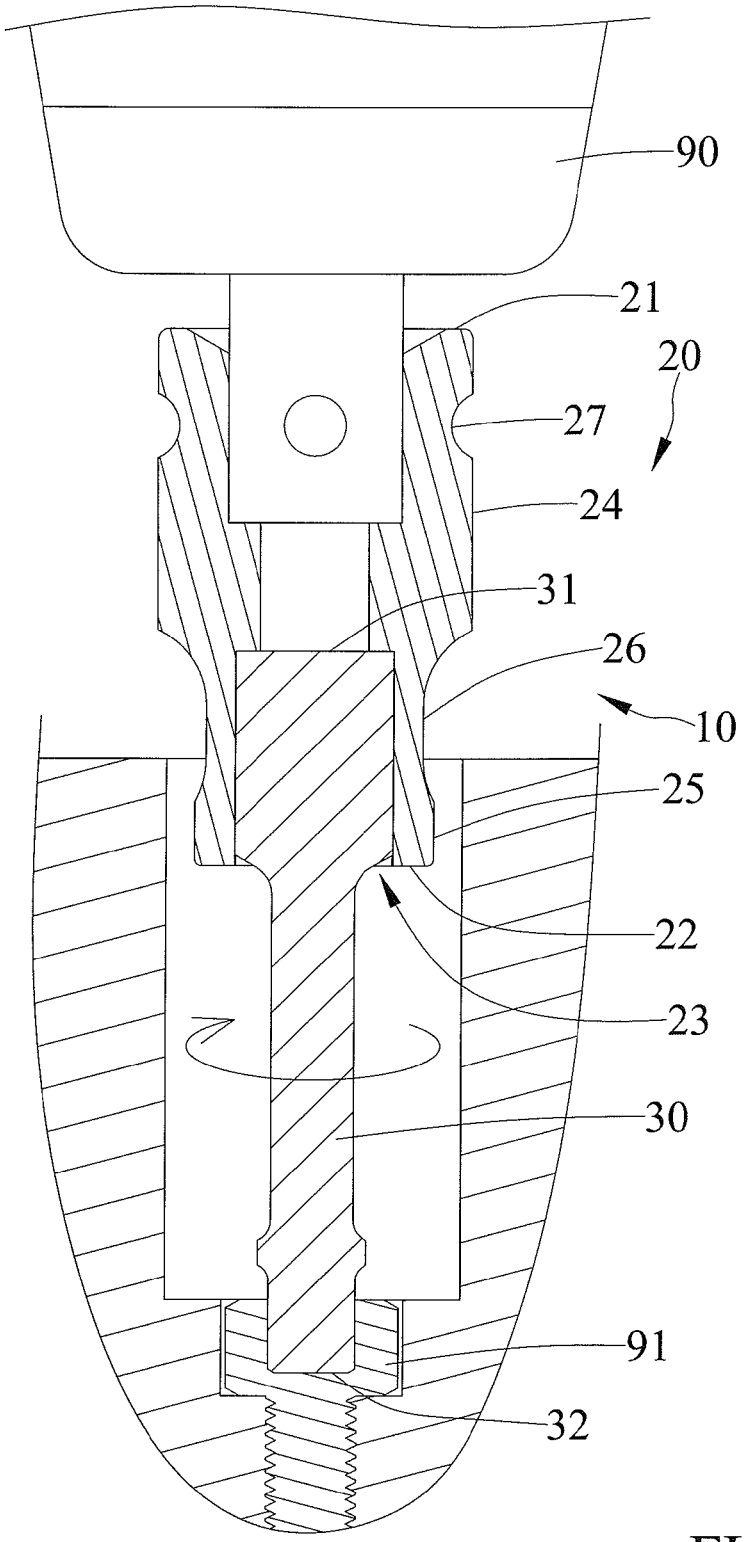
FIG. 7 is a continued view of FIG. 6.

The drive bit 30 adapted to be used to drive the object to be driven is mounted to the second end 22 of the socket 20. The drive bit 30 has a first end defining a joint end 31 and a second end opposite the first end defining a working end 32 for engaging with the object to be driven. The joint end 31 is engaged in the hole 23 and has a hexagonal shape. FIGS. 6 and 7 show the reinforced drive tool 10 in an operation of driving a fastener 91 into a blind hole. The reinforced drive tool 10 is connected to and driven by a power tool 90 and is rotated about a center axis thereof. The drive bit 30 has an end defining a joint end 31 for engaging with the socket 20. The joint end 31 is in tight engagement with and received in the hole 23. The six abutting sides 231 of the joint end 31 abut against an outer periphery of the joint end 31, so the drive bit 30 will not disengage from the socket 20 inadvertently while the reinforced drive tool 10 is in a rotational operation.

Figure 8:
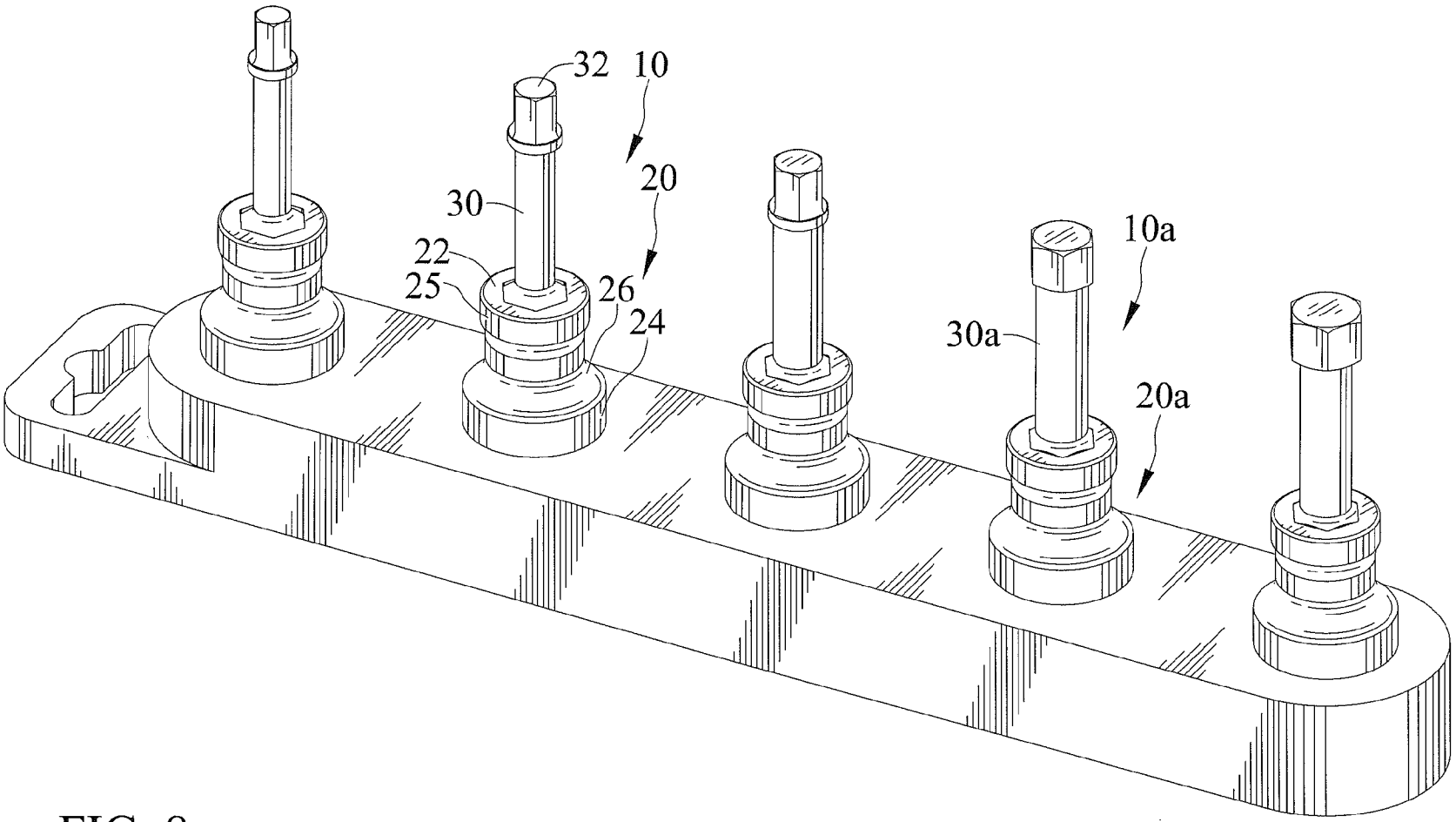
FIG. 8 is a perspective view of a second embodiment of the present invention showing reinforced drive tool sets.

FIG. 8 is a perspective view of a second embodiment of the present invention showing reinforced drive tool sets. The set includes a plurality of reinforced drive tools including that is set forth in the first embodiment, and a reinforced drive tool 10*a*. The reinforced drive tool 10*a* has a socket 20*a* the similar to the socket 20 and differentiates from the reinforced drive tool 10 in that a drive bit 30*a* includes a working end which shape is different from that of the working end 32 of the drive bit 30.

In view of the forgoing, the sockets 20 and 20*a* and the drive bit 30 and 30*a* are modularized, thereby reducing cost of manufacture. It is convenient for a user to use the reinforced drive tools 10 and 10*a* to drive the fastener 91 in the blind hole, because the second and third external diameters D2 and D3 are both smaller than the first external diameter D1, and none of the drive bits 30 and 30*a* have an external diameter greater than second and third external diameters D2 and D3. The relationship of the external diametrical sizes between the second and third sections 25 and 26 of the sockets 20 prevents high stress concentrations, and the third section 26 is reinforced by the second section 25.

While the specific embodiments have been illustrated and described, numerous modifications come to mind without significantly departing from the spirit of invention, and the scope of invention is only limited by the scope of accompanying claims.

What is claimed is:

1. A reinforced drive tool, comprising:

a socket having a first end adapted for a user to operate and a second end opposite the first end adapted to be used to drive an object to be driven by the reinforced drive tool, a hole extended along a longitudinal axis and defined at the second end of the socket, with the hole having a hexagonal cross section and defining six abutting sides and an included angle between any of the two adjacent abutting sides, with any of the two opposite abutting sides spaced at a first distance, with any of the two opposite included angles spaced at a second distance, with the socket having first, second, and third sections and each of the first, second, and third sections having a circular periphery, with the first section disposed at the first end and the second section defining a reinforcing section disposed at the second end and the third section defining a neck disposed between the first and second sections respectively, with the first, second and third sections having first, second and third external diameters respectively, with the second external diameter smaller than the first external diameter and the third external diameter smaller than the second external diameter respectively, with a difference between the second and third external diameters not less than a difference between the first and second distances; and a drive bit adapted to be used to drive the object to be driven mounted to the second end of the socket.

2. The reinforced drive tool as claimed in claim 1, wherein the third external diameter is greater than 0.8 times the second external diameter.

3. The reinforced drive tool as claimed in claim 2, wherein the first, second, and third sections of the socket has first, second, and third lengths along the longitudinal axis of the socket respectively, wherein the total of the second and third lengths is less than the first length.

4. The reinforced drive tool as claimed in claim 3, wherein the third length is less than 1.2 times the second length, wherein the third length is greater than 0.8 times the second length.

5. The reinforced drive tool as claimed in claim 4, wherein the drive bit has a first end defining a joint end and a second end opposite the first end defining a working end for engaging with the object to be driven, wherein the joint end is engaged in the hole and has a hexagonal shape.

6. The reinforced drive tool as claimed in claim 4, wherein an air channel is circumferentially extended on an outer periphery and disposed at the first end of the socket.

7. The reinforced drive tool as claimed in claim 3, wherein the second length equals the third length.

8. The reinforced drive tool as claimed in claim 1, wherein the socket is made in a one-piece structure.

9. The reinforced drive tool as claimed in claim 1, wherein the difference between the second and third external diameters equals the difference between the first and second distances.

10. A set of a plurality of reinforced drive tools, comprising:

a plurality of socket and each having a first end adapted for a user to operate and a second end opposite the first end adapted to be used to drive an object to be driven by the reinforced drive tool, a hole extended along a longitudinal axis and defined at the second end of each of the plurality of sockets, with the hole having a hexagonal cross section and defining six abutting sides and an included angle between any of the two adjacent abutting sides, with any of the two opposite abutting sides spaced at a first distance, with any of the two opposite included angles spaced at a second distance, with each of the plurality of sockets having first, second, and third sections and each of the first, second, and third sections having a circular periphery, with the first section disposed at the first end and the second section defining a reinforcing section disposed at the second end and the third section defining a neck disposed between the first and second sections respectively, with the first, second and third sections having first, second and third external diameters respectively, with the second external diameter smaller than the first external diameter and the third external diameter smaller than the second external diameter respectively, with a difference between the second and third external diameters not less than a difference between the first and second distances; and a plurality of drive bit adapted to be used to drive the object to be driven mounted to the second end of the plurality of sockets respectively.

11. The set of a plurality of reinforced drive tools as claimed in claim 10, wherein the third external diameter is greater than 0.8 times the second external diameter.

12. The set of a plurality of reinforced drive tools as claimed in claim 11, wherein each of the plurality of sockets includes the first, second, and third sections having first, second, and third lengths along the longitudinal axis of the socket respectively, wherein the total of the second and third lengths is less than the first length.

13. The set of a plurality of reinforced drive tools as claimed in claim 12, wherein the third length is less than 1.2 times the second length, wherein the third length is greater than 0.8 times the second length.

14. The set of a plurality of reinforced drive tools as claimed in claim 13, wherein each of the plurality of drive bit has a first end defining a joint end and a second end opposite the first end defining a working end for engaging with the object to be driven, wherein the joint end is engaged in the hole and has a hexagonal shape.

15. The set of a plurality of reinforced drive tools as claimed in claim 14, wherein the working ends of the plurality of the drive bits have shapes different from each other.

16. The set of a plurality of reinforced drive tools as claimed in claim 13, wherein an air channel is circumferentially extended on an outer periphery and disposed at the first end of each of the plurality of socket.

17. The set of a plurality of reinforced drive tools as claimed in claim 12, wherein the second length equals the third length.

18. The set of a plurality of reinforced drive tools as claimed in claim 10, wherein each of the plurality of socket is made in a one-piece structure.

19. The set of a plurality of reinforced drive tools as claimed in claim 10, wherein the difference between the second and third external diameters equals the difference between the first and second distances.

* * * * *